United States Patent [19]

Chang et al.

[11] Patent Number: 4,609,528

[45] Date of Patent: Sep. 2, 1986

[54] TRI-NICKEL ALUMINIDE COMPOSITIONS DUCTILE AT HOT-SHORT TEMPERATURES

[75] Inventors: Keh-Minn Chang, Schenectady; Shyh-Chin Huang, Latham; Alan I. Taub, Schenectady, all of N.Y.

[73] Assignee: General Electric Company, Schenectady, N.Y.

[21] Appl. No.: 783,582

[22] Filed: Oct. 3, 1985

[51] Int. Cl.[4] ..... B22F 1/02

[52] U.S. Cl. ..... 419/62; 419/66; 419/68; 75/0.5 C; 75/82; 75/246; 148/11.5 N; 148/11.5 P; 148/126.1; 148/162; 148/409; 148/429; 420/460; 420/590

[58] Field of Search ..... 75/0.5 C, 82, 129, 244, 75/246; 148/162, 11.5 N, 11.5 P, 126.1, 409, 429; 420/460, 490; 419/23, 62, 25, 49, 68, 66

[56] References Cited

U.S. PATENT DOCUMENTS

| | | | |
|---|---|---|---|
| 2,755,184 | 7/1956 | Turner et al. | 420/460 |
| 3,653,976 | 4/1972 | Miller et al. | 420/460 |
| 3,902,900 | 9/1975 | Restall et al. | 420/449 |
| 3,922,168 | 11/1975 | Restall et al. | 420/448 |
| 4,379,720 | 4/1983 | Ray et al. | 420/460 |
| 4,478,791 | 10/1984 | Huang et al. | 420/449 |

OTHER PUBLICATIONS

C. T. Liu & C. C. Koch, "Development of Ductile Polycrystalline $Ni_3Al$ For High-Temperature Applications", Technical Aspects of Critical Materials Use by the Steel Industry, NBSIR 83-2679-2, vol. IIB (Jun. 1983), Center for Materials Science, U.S. Dept. of Commerce, Nat'l. Bureau of Standards.

"High Temperature Ductility Minimum in Rapidly Solidified $Ni_3Al$-B", A. I. Taub, S. C. Huang and K. M. Chang, Mat. Res. Soc. Symp. Proc., vol. 39, 1985, Materials Research Society, pp. 221-228.

*Primary Examiner*—Stephen J. Lechert, Jr.

*Attorney, Agent, or Firm*—Paul E. Rochford; James C. Davis, Jr.; Paul R. Webb, II

[57] ABSTRACT

A method is taught for rendering a boron-doped tri-nickel aluminide resistant to mechanical failure while at intermediate temperatures of 600° C. to 800° C. due to a hot-short phenomena. The method involves incorporating between 0.05 and 0.30 of cobalt in the composition according to the expression $$(Ni_{1-x-z}Co_xAl_z)_{100-y}B_y.$$

The concentration of aluminum, z, is between 0.23 and 0.25 and the concentration of boron, y, is between 0.2 and 1.50 atomic percent. The composition is formed into a melt and the melt is rapidly solidified by atomization and consolidated. The consolidation may be simultaneous with the rapid solidification, as in spray forming, or sequential by atomization to a powder and consolidation of the powder by HIPping. The consolidated body is cold worked to increase the resistance of the body to failure at intermediate temperatures and may be annealed following the cold working.

17 Claims, 5 Drawing Figures

TRI-NICKEL ALUMINIDE COMPOSITIONS DUCTILE AT HOT-SHORT TEMPERATURES

CROSS-REFERENCE TO RELATED APPLICATION

Applicants draw attention to copending application Ser. No. 783,581, filed Oct. 3, 1985, assigned to the same assignee as the subject application. The copending application is incorporated herein by reference.

BACKGROUND OF THE INVENTION

The present invention relates generally to compositions having a nickel aluminide base and their processing to improve their properties. More specifically, it relates to tri-nickel aluminide base materials which may be processed into useful articles which have overcome a hot-short problem of such materials.

It is known that unmodified polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and, although potentially useful as a high temperature structural material, has not found extensive use in this application because of the poor properties of the material at room temperature.

It is known that nickel aluminide has good physical properties at temperatures of up to 1100° F. (600° C.) and could be employed, for example, in jet engines as component parts at operating or higher temperatures. However, if the material does not have favorable properties at lower temperature, including room temperature, the aluminide may break when subjected to stress at such lower temperatures at which the part would be maintained prior to starting the engine or prior to operating the engine at the higher temperatures above 1000° C.

Alloys having a tri-nickel aluminide base are among the group of alloys known as heat-resisting alloys or superalloys. These alloys are intended for very high temperature service where relatively high stresses such as tensile, thermal, vibratory and shock are encountered and where oxidation resistance is frequently required.

Accordingly, what has been sought in the field of superalloys is an alloy composition which displays favorable stress resistant properties not only at the elevated temperatures above 1000° C. at which it may be used, as for example in a jet engine, but also a practical and desirable and useful set of properties at the lower temperatures of room temperature and intermediate temperatures to which the engine is subjected in storage and during warm-up operations.

Significant efforts have been made toward producing a tri-nickel aluminide and similar superalloys which may be useful over such a wide range of temperature and adapted to withstand the stress to which the articles made from the material may be subjected in normal operations over such a wide range of temperatures. The problems of low strength and of excessive low ductility at room temperature have been largely solved.

For example, U.S. Pat. No. 4,478,791, assigned to the same assignee as the subject application, teaches a method by which a significant measure of ductility can be imparted to a tri-nickel aluminide base metal at room temperature to overcome the brittleness of this material.

Also, copending applications of the same inventors as the subject application, Ser. Nos. 647,326 647,327; 647,328; 646,877 and 646,879 filed Sept. 4, 1984 teach methods by which the composition and methods of U.S. Pat. No. 4,478,791 may be further improved. These applications are incorporated herein by reference. These and similar inventions have essentially solved the basic problem of according a tri-nickel aluminide a moderate degree of strength and ductility at lower temperatures such as room temperature.

Also, there is extensive other literature dealing with tri-nickel aluminide base compositions. For the unmodified binary intermetallic, there are many reports in the literature of a strong dependence of strength and hardness on compositional deviations from stoichiometry. E. M. Grala In "Mechanical Properties of Intermetallic Compounds", Ed. J. H. Westbrook, John Wiley, New York (1960) p. 358, found a significant improvement in the room temperature yield and tensile strength in going from the stoichiometric compound to an aluminum-rich alloy. Using hot hardness testing on a wider range of aluminum compositions, Guard and Westbrook found that at low homologous temperatures, the hardness reached a minimum near the stoichiometric composition, while at high homologous temperature the hardness peaked at the 3:1 Ni:Al ratio. TMS-AIME Trans. 215 (1959) 807. Compression tests conducted by Lopez and Hancock confirmed these trends and also showed that the effect is much stronger for Al-rich deviations than for Ni-rich deviations from stoichiometry. Phys. Stat. Sol. A2 (1970) 469. A review by Rawlings and Staton-Bevan concluded that in comparison with Ni-rich stoichiometric deviations, Al-rich deviations increase not only the ambient temperature flow stress to a greater extent, but also that the yield stress-temperature gradient is greater. J. Mat. Sci. 10 (1975) 505. Extensive studies by Aoki and Izumi report similar trends. Phys. Stat. Sol. A32 (1975) 657 and Phys. Stat. Sol. A38 (1976) 587. Similar studies by Noguchi, Oya and Suzuka also reported similar trends. Met. Trans. 12A (1981) 1647.

More recently, an article by C. T. Liu, C. L. White, C. C. Koch and E. H. Lee appearing in the "Proceedings of the Electrochemical Society on High Temperature Materials", ed. Marvin Cubicciotti, Vol. 83-7, Electrochemical Society, Inc. (1983) p. 32, discloses that the boron induced ductiliation of the same alloy system is successful only for aluminum lean $Ni_3Al$. However, while the ambient temperature brittleness problem has been solved by boron addition, Mat Res. Soc. Proc. 39 (1985) 221, to date there has been no report in the patent or other literature of a solution to the hot-short problem for the tri-nickel aluminide base alloys.

The subject application presents a further improvement in the nickel aluminide to which significant increased ductilization has been imparted and particularly improvements in the strength and ductility of tri-nickel aluminide base compositions in the temperature range above about 600° C. where the hot-short condition has been found to occur. $Ni_3Al$ compositions also display low ductility or a hot-short in a temperature over 600° C. and particularly from about 600° C. to about 800° C.

It should be emphasized that materials which exhibit good strength and adequate ductility are very valuable and useful in applications below about 600° C. (1100° F). There are many applications for strong oxidation resistant alloys at temperature of 1100° F. and below. The tri-nickel aluminide alloys which have appreciable ductility and good strength at room temperatures and which have oxidation resistance and good strength and ductility at temperatures up to about 1100° F. are highly valuable for numerous structural applications in high temperature environments.

BRIEF SUMMARY OF THE INVENTION

It is accordingly one object of the present invention to provide a method of improving the properties of articles adapted to use in structural parts at room temperature as well as at intermediate and elevated temperatures of over 1000° C.

Another object is to provide an article suitable for withstanding significant degrees of stress and for providing appreciable ductility at room temperature as well as at elevated temperatures of up to about 1100° F.

Another object is to provide a consolidated material which can be formed into useful parts having the combination of properties of significant strength and ductility at room temperature and at elevated temperatures of up to about 1100° F. (600° C.).

Another object is to provide a consolidated tri-nickel aluminide material which has a combination of strength and ductility which was heretofore unattainable in the hot-short temperature range.

Another object is to provide parts consolidated from powder which have a set of properties useful in applications such as jet engines and which may be subjected to a variety of forms of stress in the hot-short temperature range.

Other objects will be in part apparent and in part set forth in the description which follows.

In one of its broader aspects an object of the present invention may be achieved by providing a melt having a tri-nickel aluminide base and containing a relatively small pecentage of boron and which may contain one or more substituents including cobalt. The melt is then atomized by inert gas atomization. The melt is rapidly solidified to powder during the atomization. The material may then be consolidated by hot isostatic pressing at a temperature of about 1150° C. and at about 15 ksi for about two hours. The isostatically pressed sample is cold rolled and annealed to impart a set of significantly improved properties to the sample. Alternatively, the molten metal stream being atomized may be intercepted as part of a spray forming process to form a consolidated body.

Although the melt referred to above should ideally consist only of the atoms of the intermetallic phase and substituents as well as atoms of boron, it is recognized that occasionally and inevitably other atoms of one or more incidental impurity atoms may be present in the melt.

As used herein the expression tri-nickel aluminide base composition refers to a tri-nickel aluminide which contains impurities which are conventionally found in nickel aluminide compositions. It includes as well other constituents and/or substituents in addition to cobalt which do not detract from the unique set of favorable properties which are achieved through practice of the present invention.

BRIEF DESCRIPTION OF THE DRAWINGS

The description which follows will be understood with greater clarity by reference to the accompanying drawings in which.

DETAILED DESCRIPTION OF THE INVENTION

Figure 1:
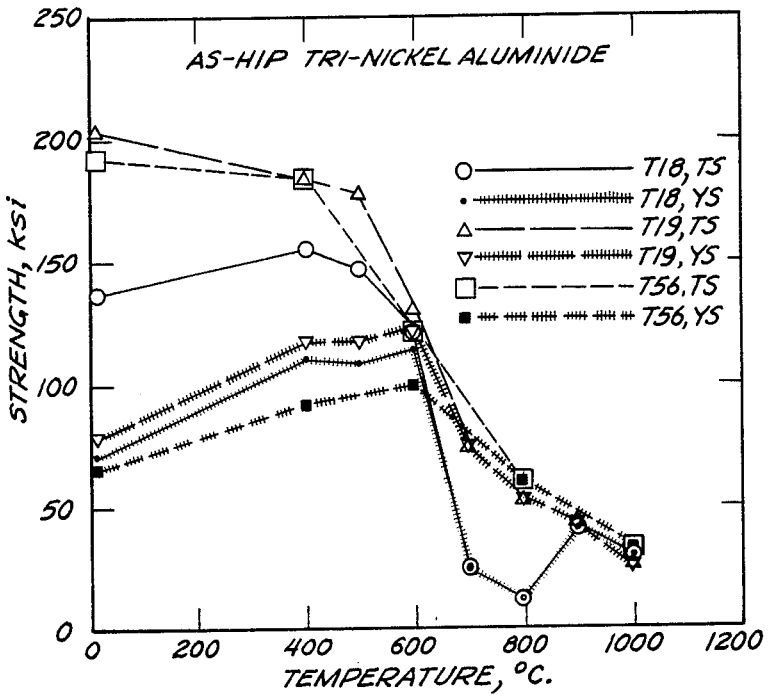
FIG. 1 is a set of graphs of the tensile properties in ksi of a set of three alloys the results of which are described below.

Nickel aluminide is found in the nickel-aluminum binary system and as the gamma prime phase of conventional gamma/gamma prime nickel-base superalloys. Nickle aluminide has high hardness and is stable and resistant to oxidation and corrosion at elevated temperatures which makes it attractive as a potential structural material.

Nickel aluminide, which has a face centered cubic (FCC) crystal structure of the $Cu_3Al$ type ($Ll_2$ in the Stukturbericht designation which is the designation used herein and in the appended claims) with a lattice parameter $a_o=3.589$ at 75 at. % Ni and melts in the range of from about 1385° to 1395° C., is formed from aluminum and nickel which have melting points of 660° and 1453° C., respectively. Although frequently referred to as $Ni_3Al$, tri-nickel aluminide is an intermetallic phase and not a compound as it exists over a range of compositions as a function of temperature, e.g., about 72.5 to 77 at. % Ni (85.1 to 87.8 wt. %) at 600° C.

Polycrystalline $Ni_3Al$ by itself is quite brittle and shatters under stress as applied in efforts to form the material into useful objects or to use such an article.

It was discovered that the inclusion of boron in the rapidly cooled and solidified alloy system can impart desirable ductility to the rapidly solidified alloy as taught in U.S. Pat. No. 4,478,791.

It has been discovered that certain metals can be beneficially substituted in part for the constituent metal nickel. This substituted metal is designated and known herein as a substituent metal, i.e. as a nickel substituent in the $Ni_3Al$ structure or an aluminum substituent.

By a substituent metal is meant a metal which takes the place of and in this way is substituted for another and different ingredient metal, where the other ingredient metal is part of a desirable combination of ingredient metals which ingredient metals form the essential constituent of an alloy system.

For example, in the case of the superalloy system $Ni_3Al$ or the tri-nickel aluminide base superalloy, the ingredient or constituent metals are nickel and aluminum. The metals are present in the stoichiometric atomic ratio of 3 nickel atoms for each aluminum atom in this system.

The beneficial incorporation of substituent metals in tri-nickel aluminide to form tri-nickel aluminide base compositions is disclosed and described in the copending applications referenced above.

Moreover, it has been discovered that valuable and beneficial properties are imparted to the rapidly solidified compositions which have the stoichiometric proportions but which have a substituent metal as a quaternary ingredient of such a rapidly solidified alloy system. This discovery, as it relates to a cobalt substituent, is described in copending application Ser. No. 647,326 filed Sept. 9, 1984 and assigned to the same assignee as the subject application. This application is referenced above and has been incorporated herein by reference.

The alloy compositions of the prior and also of the present invention must also contain boron as a tertiary ingredient as taught herein and as taught in U.S. Pat. No. 4,478,791. A preferred range for the boron tertiary additive is between 0.25 and 1.50%.

By the prior teaching of U.S. Pat. No. 4,478,791, it was found that the optimum boron addition was in the range of 1 atomic percent and permitted a yield strength value at room temperature of about 100 ksi to be achieved for the rapidly solidified product. The fracture strain of such a product was about 10% at room temperature.

The composition which is formed must have a preselected intermetallic phase having a crystal structure of the $Ll_2$ type and must have been formed by cooling a melt at a cooling rate of at least about $10^{3}$° C. per second to form a solid body the principal phase of which is of the $Ll_2$ type crystal structure in either its ordered or disordered state.

The alloys prepared according to the teaching of U.S. Pat. No. 4,478,791 as rapidly solidified cast ribbons have been found to have a highly desirable combination of strength and ductility at room temperature. The ductility achieved is particularly significant in comparison to the zero level of ductility of previous samples.

However, it was found that annealing of the cast ribbons led to a loss of ductility. An annealing embrittlement was observed. It is described in copending application Ser. No. 783,718, filed Oct. 3, 1985. Such annealing embrittlement leads to a low temperature brittleness.

A significant advance in overcoming the annealing embrittlement is achieved by preparing a specimen of tri-nickel aluminide base alloy through a combination of atomization and consolidation techniques. This is also described in the copending application Ser. No. 783,718, filed Oct. 3, 1985.

It has been found that tri-nickel aluminide base compositions are also subject to an intermediate temperature ductility minimum. This minimum has been found to occur in the intermediate temperature range of about 600° C. to about 800° C.

We have discovered that the hot-short problem can be overcome through a combination of alloying and thermomechanical processing steps.

EXAMPLE 1

A set of tri-nickel aluminide base alloys were each individually vacuum induction melted to form a ten pound heat. The compositions of the alloys in atomic percent are listed in Table I below.

In all of the alloys set forth in this application, the ingredients are given in the amounts and percentages which were added to form the compositions and are not based on analysis of the alloy after formation.

TABLE I

| Alloy | Ni | Co | Al | B |
|---|---|---|---|---|
| T-18 | bal. | — | 24.77 | 0.93 |
| T-19 | bal. | 9.91 | 24.75 | 0.98 |
| T-56 | bal. | — | 23.82 | 0.75 |

The ingots formed from the vacuum melting were re-melted and were then atomized in argon. The atomization was carried out in accordance with one or more of the methods taught in copending applications for patent of S. A. Miller, Ser. Nos. 584,687; 584,688; 584,689; 584,690 and 584,691, filed Feb. 28, 1984 and assigned to the assignee of this application. These applications are incorporated herein by reference. Other and conventional atomization processes may be employed to form rapidly solidified powder to be consolidated. The powder produced was screened and the fraction having particle sizes of −100 mesh or smaller were selected.

The selected powder was sealed into a metal container and HIPped. The HIP process is a hot-isostatic-pressing process known in the art. In this example, the selected powder specimens were HIPped at about 1150° C. and at about 15 ksi pressure for a period of about 2 hours.

Room temperature mechanical properties of the consolidated specimens were evaluated in the as-HIP condition. The results are set forth in Table IIA below.

In the tables and other presentation of data which follows, the abbreviations used and their meanings are as follows: Y.S. is yield strength in ksi; ksi is thousand pounds per square inch; T.S. is tensile strength in ksi; U.L. is uniform elongation in percent; uniform elongation is the elongation as measured at the point of maximum strength of a test sample; E.L. is total elongation in percent; total elongation is the amount of elongation of a test specimen at the point of failure. Where E.L. is greater than U.L., this is an indication that necking has occurred.

TABLE IIA

| Room Temperature Properties of as HIPped Samples | | | |
|---|---|---|---|
| Alloy Sample | T-18 | T-19 | T-56 |
| Y.S. (ksi) | 72 | 79 | 66 |
| T.S. (ksi) | 138 | 203 | 193 |
| U.L. (%) | 13 | 35 | 42 |
| E.L. (%) | 13 | 35 | 45 |

Each of these samples has a desirable combination of strength and ductility properties at room temperature or at about 20° C.

However, each sample displays a substantial loss of ductility at elevated temperature as is made evident from tests of the properties of samples of the same alloys at elevated temperatures as set out in Table IIB for alloy T-18; Table IIC for alloy T-19 and Table IID for alloy T-56 below.

TABLE IIB

| Elevated Temperature Properties of As-HIPped Samples of Alloy T-18 | | | | | |
|---|---|---|---|---|---|
| | Test Temp (°C.) | YS (ksi) | TS (ksi) | UL (%) | EL (%) |
| T-18 | 20 | 72 | 138 | 13 | 13 |
| T-18 | 400 | 111 | 156 | 12 | 12 |
| T-18 | 500 | 109 | 148 | 9 | 9 |
| T-18 | 600 | 115 | 122 | 1 | 1 |
| T-18 | 700 | — | 25 | 0 | 0 |

TABLE IIB-continued

Elevated Temperature Properties of As-HIPped Samples of Alloy T-18

| | Test Temp (°C.) | YS (ksi) | TS (ksi) | UL (%) | EL (%) |
|---|---|---|---|---|---|
| T-18 | 800 | — | 12 | 0 | 0 |
| T-18 | 900 | — | 42 | 0 | 0 |
| T-18 | 1000 | 31 | 31 | 1 | 1 |

TABLE IIC

Elevated Temperature Properties of As-HIPped Samples of Alloy T-19

| | Test Temp (°C.) | YS (ksi) | TS (ksi) | UL (%) | EL (%) |
|---|---|---|---|---|---|
| T-19 | 20 | 79 | 203 | 35 | 35 |
| T-19 | 400 | 118 | 184 | 29 | 29 |
| T-19 | 500 | 118 | 178 | 26 | 26 |
| T-19 | 600 | 123 | 132 | 1 | 1 |
| T-19 | 700 | — | 75 | 0 | 0 |
| T-19 | 800 | — | 53 | 0 | 0 |
| T-19 | 900 | 43 | 43 | 1 | 1 |
| T-19 | 1000 | 27 | 27 | 1 | 2 |

TABLE IID

Elevated Temperature Properties Of-HIPped Samples of Alloy T-56

| | Test Temp (°C.) | T56 YS (ksi) | T56 TS (ksi) | UL (%) | EL (%) |
|---|---|---|---|---|---|
| T-56 | 20 | 66 | 193 | 42 | 45 |
| T-56 | 400 | 92 | 185 | 41 | 41 |
| T-56 | 600 | 100 | 122 | 12 | 16 |
| T-56 | 800 | — | 61 | 0 | 0 |
| T-56 | 1000 | 33 | 33 | 0 | 0 |

Figure 2:
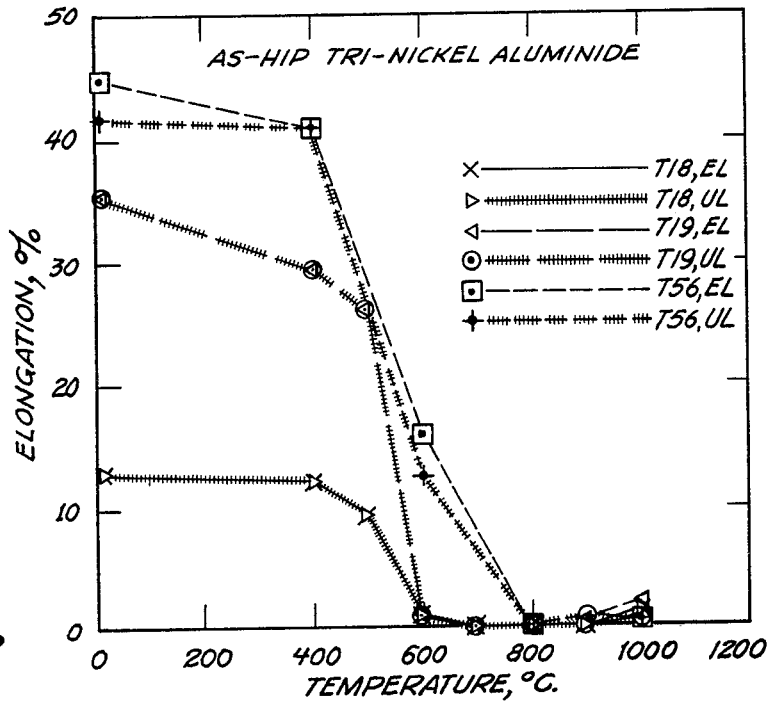
FIG. 2 is a similar set of graphs of test results for the set of three alloys but in this figure displaying elongation properties in percent.

The data in the above Tables IIA, IIB, IIC and IID are plotted in FIGS. 1 and 2.

From the plot of FIG. 1 it is evident that there is a substantial reduction in strength starting at about 600° C.

From the plot of FIG. 2 it is further evident that each of these alloy samples suffers a ductility minimum in the temperature range of about 600° C. to about 900° C. Essentially all of the as HIPped alloy samples have a ductility of zero at a temperature of 800° C.

Also, from the plot of FIG. 2, it is evident that at temperatures above the ductility minimum the ductility increases. The ductility of each sample alloy is higher at 1000° C. than it is at 800° C. This is characteristic of a hot-short condition in that the ductility minimum occurs over a temperature range but the ductility is higher at lower temperatures outside the range and also at higher temperatures outside the range.

EXAMPLE 2

A set of three samples of as-HIPped alloys prepared as described in Example 1 were annealed. The physical properties of the annealed samples were tested and are listed with those of the as-HIPped samples in Table IIIA. Table IIIA lists HIPping and annealing temperatures for the specimens of Example 1 and Table IIIB, Table IIIC and Table IIID list room temperature mechanical properties for the as-HIPped samples and also for the as-HIPped and annealed samples.

TABLE IIIA

Temperature of HIP and Anneal Temperature and Time of Sample Specimens

| | T-18 | T-19 | T-56 |
|---|---|---|---|
| HIP Temp: | 1165° C. | 1143° C. | 1150° C. |
| Anneal Temp: | 1000° C. | 1000° C. | 1000° C. |
| Anneal Time: | 2 hrs. | 2 hrs. | 1 hr. |

TABLE IIIB

Room Temperature Properties of as-HIPped and of HIPped and annealed specimens of T-18 Alloy

| | YS | TS | UL | EL |
|---|---|---|---|---|
| T-18 as HIP | 72 | 138 | 13 | 13 |
| T-18 HIP and anneal | 72 | 154 | 17 | 17 |

TABLE IIIC

Room Temperature Properties of as-HIPped and of HIPped and Annealed Specimens of T-19 Alloy

| | YS | TS | UL | EL |
|---|---|---|---|---|
| T-19 as HIP | 79 | 203 | 35 | 35 |
| T-19 HIP and anneal | 84 | 203 | 33 | 33 |

TABLE IIID

Room Temperature Properties of as-HIPped and of HIPped and Annealed Specimens of T-56 Alloy

| | YS | TS | UL | EL |
|---|---|---|---|---|
| T-56 as HIP | 66 | 193 | 42 | 45 |
| T-56 HIP and anneal | 66 | 192 | 41 | 46 |

It is evident that there was no significant change of values of elongation for any of the specimens measured following the anneal as compared to the as-HIPped specimens.

EXAMPLE 3

Consolidated specimens of the T-18 alloy powder prepared as described in Example 1 were subjected to various combinations of heating, cooling and cold working and to various sequences of heating, cooling and cold working.

In this example, the specimens of T-18 referenced in Example 1 were treated and tested as set forth in Table IV below.

The steps applied are listed under the heading *Processing Conditions* and the values of the room temperature mechanical properties found are also listed in the accompanying Table IV.

TABLE IV

Effect of Thermo-Mechanical Processing on Room Temperature Tensile Properties of Alloy T-18

| Processing Condition | Y.S. (ksi) | T.S. (ksi) | El. (%) |
|---|---|---|---|
| As-HIPped (at 1165° C. and 15 ksi for 2 hours) | 72 | 138 | 13 |
| HIPped and annealed at 1100° C. for 2 hours and salt bath quenched | 73 | 85 | 3 |
| HIPped and annealed at 1000° C. for 2 hours | 72 | 154 | 17 |
| HIPped and cold rolled and 1150° C. annealed for 1 hour and water quenched | 73 | 181 | 28 |
| HIPped and cold rolled and 1150° C. annealed for 2 hours and chamber cooled | 73 | 194 | 36 |

TABLE IV-continued

Effect of Thermo-Mechanical Processing on Room Temperature Tensile Properties of Alloy T-18

| Processing Condition | Y.S. (ksi) | T.S. (ksi) | El. (%) |
|---|---|---|---|
| HIPped and cold rolled and 1150° C. annealed for 1 hour and furnace cooled | 73 | 183 | 30 |
| HIPped and cold rolled and 1000° C. annealed for 24 hours and chamber cooled | 73 | 194 | 33 |

It is evident from the property values listed in the above table that, compared to just annealing, significant improvements in strength and ductility can be achieved through a combination of cold working and annealing of boron doped tri-nickel aluminide base alloys which have been atomized from a melt to powder and which have then been consolidated by HIPping.

EXAMPLE 4

Consolidated specimens of the T-18, T-19 and T-56 alloy powders prepared as described in Example 1 and then cold worked and annealed were tested at temperatures in the range whre the tri-nickel aluminide base compositions have exhibited a ductility minimum, namely in the temperature range of 600° C. to 800° C.

The tensile properties of the samples of the consolidated T-18, T-19 and T-56 alloy powders as-HIPped and following thermo-mechanical processing were measured and the test values determined are listed in the accompanying Table VA, VB and VC. The as-HIPped properties are as listed in Table II above but are included here for side by side comparison.

TABLE VA

Property Comparison Between As-HIPped and Thermo-Mechanically Processed T-18 Alloy

| | Test Temp | YS | TS | UL | EL |
|---|---|---|---|---|---|
| T-18* | 600 | 115 | 122 | 1 | 1 |
| T-18* | 800 | | 12 | 0 | 0 |
| T-18** | 600 | 122 | 125 | 1 | 1 |
| T-18** | 800 | | 35 | 0 | 0 |

*As-HIPped
**HIPped, cold worked 10% and annealed 1 hour at 1000° C.

The value of ductility found for the T-18 alloy at 800° C. as listed in Table VA above is deficient so that an alloy of this composition prepared as described has no utility at intermediate temperatures of 800° C. However, from other data in this application, it is evident that the cold worked and annealed consolidated powder composition of T-18 has a highly useful and valuable set of properties for use at room temperature and at temperatures up to about (1137° F.) 600° C. The same is true for the alloy T-56, the test property values of which are listed in Table VC below.

TABLE VB

Property Comparison Between As-HIPped and Thermo-Mechanically Processed T-19 Alloy

| | Test Temp | YS | TS | UL | EL |
|---|---|---|---|---|---|
| T-19* | 600 | 123 | 132 | 1 | 1 |
| T-19* | 800 | | 53 | 0 | 0 |
| T-19** | 600 | 131 | 152 | 13 | 17 |
| T-19** | 800 | 73 | 82 | 2 | 4 |

*As-HIPped
**HIPped, cold worked 25% and annealed 1 hour at 1000° C.

TABLE VC

Property Comparison Between As-HIPped and Thermo-Mechanically Processed T-56 Alloy

| | Test Temp | YS | TS | UL | EL |
|---|---|---|---|---|---|
| T-56* | 600 | 100 | 122 | 12 | 16 |
| T-56* | 800 | 61 | 61 | 0 | 0 |
| T-56** | 600 | 108 | 130 | 9 | 13 |
| T-56** | 800 | 77 | 80 | 0 | 0 |

*As-HIPped
**HIPped, cold worked 10% and annealed 1 hour at 1000° C.

From this data, it is evident that there is no loss of strength properties as a result of the thermo-mechanical processing, i.e., cold rolling followed by annealing.

It is evident from a consideration of the data of Table VB and from comparison of the values determined at 600 and 800° C. that the boron doped cobalt containing tri-nickel aluminide of alloy T-19 has a very surprising high ductility after cold working and annealing which is not present or achieved in the as-HIPped material.

Further, from the data of this and the accompanying Tables, it is evident that there is a remarkable improvement in the ductility of the cold worked and annealed sample at both 600° C. and at 800° C.

Figure 3:
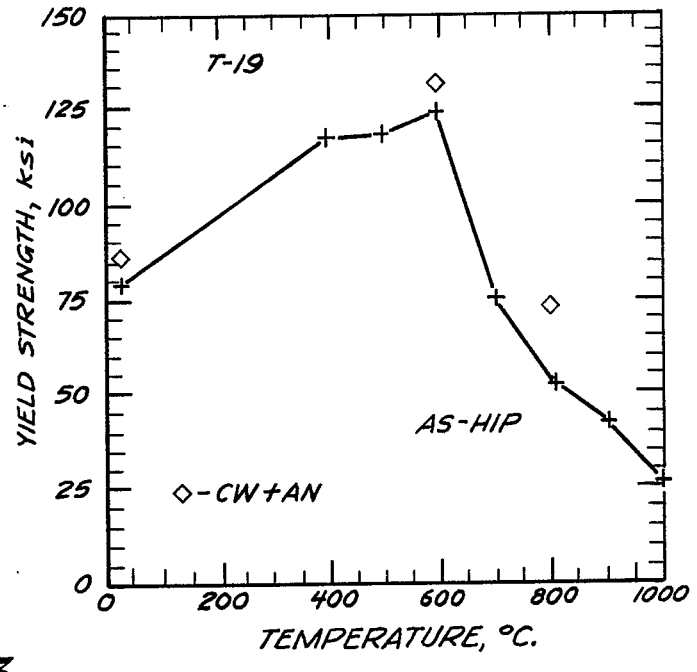
FIG. 3 is a graph in which yield strength in ksi is plotted against temperature in degrees centigrade.
Figure 4:
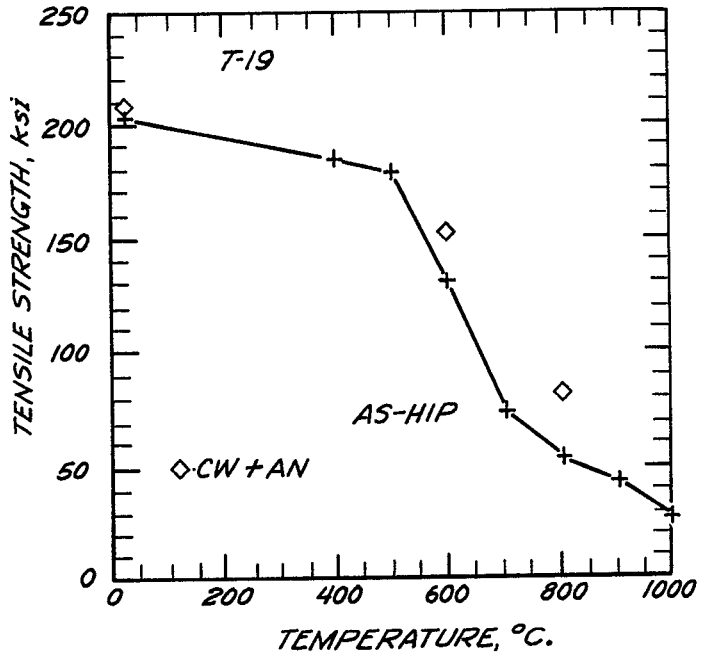
FIG. 4 is a graph in which tensile strength is plotted against temperature.
Figure 5:
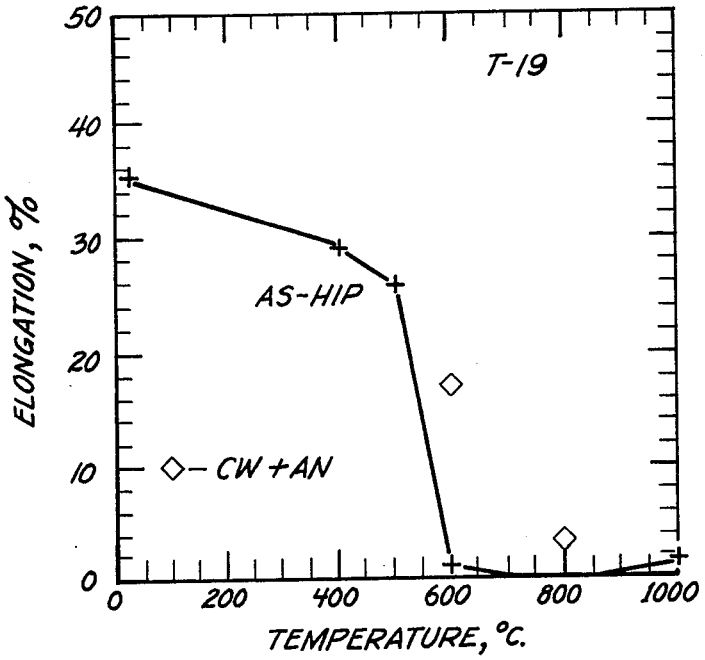
FIG. 5 is a graph in which elongation in percent is plotted against temperature.

Experimental data as to the improvement made possible by the cold work and anneal of the consolidated T-19 alloy powder is presented in the accompanying FIGS. 3, 4 and 5 as an alternative way of displaying the novel findings of this invention and the advantages which are made possible.

In FIG. 3, the yield strength is plotted as ordinate against the temperature of the test sample as abscissa. The values of yield strength found for the as-HIPped composition is plotted as a solid line connecting the plus, +, signs. The values found for the cold worked and annealed specimens are plotted as diamonds. As is evident from the figure, the cold working and annealing of the T-19 tri-nickel aluminum base composition did not result in any loss of yield strength. Rather at each temperature where a measurement was made, the value for the cold worked and annealed specimens was higher. In the case of the measurements made at 800° C., the value found for the thermo-mechanically treated specimen was approximately 40% higher.

A similar result was obtained from measurements of tensile strength as is evident from FIG. 4.

The results plotted in FIG. 5 demonstrate that not only are higher values of tensile strength and yield strength obtained from the cold worked and annealed specimens but most important of all, the cold worked and annealed specimens retain significant measures of ductility at elevated temperatures. This is in sharp and dramatic contrast to the values of elongation (ductility) which are obtained from the as-HIPped sample of T-19 alloy, the values of which are also plotted in FIG. 5.

It is one of the unique findings of the present invention that the intermediate temperature ductility of a cobalt-containing boron doped tri-nickel aluminide may be improved by preparing a melt of the cobalt containing tri-nickel aluminide to contain 0.2 to 1.5 atomic percent boron, rapidly solidifying the melt to a powder by gas atomization, consolidating the powder to a solid body by high temperature isostatic pressing, and cold working the consolidated body.

EXAMPLE 5

A boron doped tri-nickel aluminide alloy was prepared by conventional casting techniques and mechanically worked.

The alloy had the composition as set forth in Table VIA. The ingredients are given in atomic percent.

TABLE VIA

| Alloy | Nickel | Cobalt | Aluminum | Boron |
|---|---|---|---|---|
| T-5 | Balance | 14.85 | 23.76 | 1.0 |

The ingredients were formed into a melt by induction melting, introduced into a copper chill mold and then allowed to cool to form an ingot. The ingot was processed through a series of cold rolls and anneals with each cold roll being followed by an anneal for two hours at 1100° C.

The rolling schedule was as follows:

5% reduction and anneal at 1100° C.

5% reduction and anneal at 1100° C.

10% reduction and anneal at 1100° C.

15% reduction and anneal at 1100° C.

Samples of the rolled ingot were taken following the series of cold rolls and anneals to test mechanical properties. The mechanical properties found are listed in Table VIB.

TABLE VIB

| Test Temp. | Y.S. (ksi) | T.S. (ksi) | U.L. (%) | T.L. (%) |
|---|---|---|---|---|
| 24 | 76 | 180 | 38 | 39 |
| 400 | 100 | 163 | 31 | 31 |
| 500 | 121 | 141 | 4.8 | 5.2 |
| 600 | 123 | 129 | 0.6 | 0.6 |
| 700 | — | 59 | 0.0 | 0.0 |

It is evident from the test data plotted in Table VIB that despite extensive thermo-mechanical processing the ductility of the cast samples are inadequate and deficient in the hot-short temperature range of 600° C. and 700° C.

EXAMPLE 6

The alloy T-5 as set forth in Example 5 above was formed into a second ingot by the method described in Example 5. The second ingot was thermo-mechanically processed by a more severe set of rollings and a set of anneals at lower temperature and specifically at 1000° C. rather than the 1100° C. temperature employed in Example 5.

The initial reduction was 12% followed by a 1000° C. anneal for two hours. The next two reductions were at higher percentages and each was followed by a two hour anneal at 1000° C. The fourth and final rolling reduction was about a 30% reduction and was followed by a two hour anneal at 1000° C.

The above practice of rolling reductions and anneals were carried out as described in a journal article by Liu et al. and specifically C. T. Liu, C. L. White and J. A. Horton; Acta. Met. 33 (1985) p. 213.

Test specimens were prepared from the rolled ingot and mechanical properties were measured. The mechanical properties determined from these tests are listed in Table VII below.

TABLE VII

| Test Temp (°C.) | Y.S. (ksi) | T.S. (ksi) | U.L. (%) | E.L. (%) |
|---|---|---|---|---|
| 24 | 89 | 189 | 45 | 48 |
| 600 | 116 | 123 | 0.7 | 0.7 |
| 700 | 90 | 94 | 0.6 | 0.6 |

From the data of Table VII it is evident that the ductility of the cast and mechanically worked and annealed sample in the hot-short temperature range of 600° C. and 700° C. is deficient and that the material of the cast ingot of the alloy is accordingly defective in this respect.

EXAMPLE 7

An ingot was formed by vacuum melting to have the following composition as set out in Table VIIIA. The concentrations indicated are based on quantities of ingredients added.

TABLE VIIIA

| Alloy | Nickel | Cobalt | Aluminum | Boron |
|---|---|---|---|---|
| T-6 | Balance | 9.93 | 23.82 | 0.75 |

The melt was atomized and collected as a dense body on a cold collecting surface according to a spray forming process. One such spray forming process is disclosed in U.S. Pat. Nos. 3,826,301 and 3,909,921. Other processes may also be employed. The deposit formed was removed and subjected to a series of treatments including thermal and thermo-mechanical processing.

As for each of the processing steps of this and the other examples above, a test specimen was prepared from the material following each step of processing so that changes in mechanical properties could be determined as they are modified by each processing stage. The processing steps and the test results determined following each processing step are listed in Table VIIIB below.

TABLE VIIIB

| | Mechanical Properties at 600° C. (Strain rate 0.11 per minute) | | | |
|---|---|---|---|---|
| Condition | Y.S. (ksi) | T.S. (ksi) | E.L. (%) | U.L. % |
| As-deposited | 104 | 104 | 0.26 | 0.21 |
| Two hour anneal at 1000° C. | 109 | 109 | 0.31 | 0.31 |
| Cold work 22% followed by 2 hour anneal at 1000° C. | 114 | 148 | 38 | 25 |

As is evident from the data recorded in Table VIIIB, the properties of the sample are greatly improved as a result of the cold working practice of the present invention. Not only is the tensile property significantly improved, but the ductility is also very markedly improved from a fractional percent to about 25%, an improvement of some 7500%.

What is claimed and sought to be protected by Letters Patent of the United States is as follows:

1. The method of improving the intermediate temperature properties of a boron doped tri-nickel aluminide composition which comprises forming a cobalt alloy of the aluminide according to the following expression:

$(Ni_{1-x-z}Co_xAl_z)_{100-y}B_y$ wherein x is between 0.05 and 0.30 z is between 0.23 and 0.25 y is between 0.2 and 1.50 and forming a melt of the alloy, rapidly solidifying the alloy from the melt, consolidating the alloy and cold working the consolidated alloy.

2. The method of claim 1 wherein the alloy is annealed following the cold working.

3. The method of claim 1 wherein the cobalt ratio, x, is between 0.05 and 0.20.

4. The method of claim 1 wherein the cobalt ratio, x, is about 10.

5. The method of claim 1 wherein the aluminum ratio, z, is between 0.23 and 0.245.

6. The method of claim 1 wherein the aluminum ratio, z, is about 0.24.

7. The method of claim 1 wherein the boron concentration, y, is between 0.2 and 1.0.

8. The method of clain 1 wherein the boron concentration is between 0.5 and 1.0.

9. The method of improving the intermediate temperature properties of a boron doped tri-nickel aluminide which comprises forming a cobalt alloy of the aluminide according to the following expression:

$(Ni_{1-x-z}Co_xAl_z)_{100-y}B_y$ wherein x is between 0.05 and 0.30 z is between 0.23 and 0.25 y is between 0.2 and 1.50 forming a melt of the alloy, atomizing the melt onto a shaped, cooled, collecting surface to form a body and cold working the body of the tri-nickel aluminide.

10. The method of claim 9 in which the cold worked body is annealed following the cold working.

11. The method of claim 9 in which the cold worked body is annealed at about 1000° C. for about 2 hours.

12. The method of improving the intermediate temperature properties of a boron doped tri-nickel aluminide which comprises forming a cobalt alloy of the aluminide according to the following expression:

$(Ni_{1-x-z}Co_xAl_z)_{100-y}B_y$ wherein x is between 0.05 and 0.30 z is between 0.23 and 0.25 y is between 0.2 and 1.50 forming a melt of the alloy, atomizing the melt to a powder, collecting the powder and HIPping the collected powder to form a body and cold working the body of the tri-nickel aluminide.

13. The method of claim 12 in which the cold worked body is annealed following the cold working.

14. The method of claim 12 in which the cold worked body is annealed at about 1000° C. for about 2 hours.

15. The method of improving the intermediate temperature properties of a boron doped tri-nickel aluminide which comprises forming a cobalt alloy of the aluminide according to the following expression:

$(Ni_{1-x-z}Co_xAl_z)_{100-y}B_y$ wherein x is between 0.05 and 0.30 z is between 0.23 and 0.25 y is between 0.2 and 1.50 forming a melt of the alloy, atomizing the melt into a powder, plasma spraying the powder to form a body and cold working the body of the tri-nickel aluminide.

16. The method of claim 15 in which the cold worked body is annealed following the cold working.

17. The method of claim 15 in which the cold worked body is annealed at about 1000° C. for about 2 hours.

* * * * *